US005980034A

United States Patent [19]

Tsai et al.

[11] Patent Number: 5,980,034

[45] **Date of Patent: *Nov. 9, 1999**

[54] CROSS FLOW NOZZLE SYSTEM FOR AN INK JET PRINTER

[75] Inventors: Jianming Tsai, Schaumburg; Pietro Lostumbo, Wooddale, both of Ill.

[73] Assignee: Videojet Systems International, Inc., Wood Dale, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/613,838

[22] Filed: Mar. 11, 1996

[51] Int. Cl.[6] ..... B41J 2/18

[52] U.S. Cl. ..... 347/89

[58] Field of Search ..... 347/89, 90, 6, 347/7

[56] References Cited

U.S. PATENT DOCUMENTS

| | | | |
|---|---|---|---|
| 4,074,284 | 2/1978 | Dexter et al. | 347/68 |
| 4,121,222 | 10/1978 | Diebold et al. . | |
| 4,432,003 | 2/1984 | Barbero et al. | 347/89 |
| 4,433,341 | 2/1984 | Thomas | 347/89 |
| 4,463,359 | 7/1984 | Ayata et al. | 347/56 |
| 4,555,712 | 11/1985 | Arway et al. . | |
| 4,591,873 | 5/1986 | McCann et al. . | |
| 4,628,329 | 12/1986 | Regnault . | |
| 4,771,297 | 9/1988 | Lecheheb et al. . | |
| 4,910,529 | 3/1990 | Regnault . | |
| 4,947,187 | 8/1990 | Iwagami . | |
| 5,087,924 | 2/1992 | Zaba et al. . | |
| 5,126,752 | 6/1992 | Weinberg . | |
| 5,153,613 | 10/1992 | Yamaguchi et al. . | |
| 5,153,614 | 10/1992 | Yamaguchi et al. . | |
| 5,296,876 | 3/1994 | Yamaguchi et al. . | |
| 5,311,214 | 5/1994 | Hirasawa et al. . | |
| 5,379,061 | 1/1995 | Yamaguchi et al. . | |
| 5,381,168 | 1/1995 | Kondo et al. . | |
| 5,389,961 | 2/1995 | Takagi . | |
| 5,455,606 | 10/1995 | Keeling et al. . | |

FOREIGN PATENT DOCUMENTS

| | | |
|---|---|---|
| 01 040341 | 2/1989 | Japan . |
| 03 295661 | 4/1992 | Japan . |
| 04 028559 | 5/1992 | Japan . |
| PCT/GB94/00143 | 8/1994 | WIPO . |

OTHER PUBLICATIONS

Videojet Cheshire SR 25/50 Superior Resolution Imaging System Technical Manual, Jun. 1993.

Colin Sharpe, Technical Appraisal of the Willmett–Prontos 3800 Continuous Ink Jet Printer, Jun. 24, 1988.

*Primary Examiner*—N. Le
*Assistant Examiner*—Judy Nguyen
*Attorney, Agent, or Firm*—Rudnick & Wolfe

[57] ABSTRACT

An anti-clogging nozzle system for a continuous jet ink jet printer is disclosed. A printing nozzle has both an ink inlet and an ink outlet permitting constant ink flow behind the nozzle orifice during printing. A pressure sensor monitors the ink flow and signals clogs to an automatic unclogging system. The unclogging system includes a control circuit to initiate an unclogging operating cycle when necessary. One of two unclogging modes is employed, both of which require the control system to operate an unclogging valve to vary pressure in the ink return line.

20 Claims, 4 Drawing Sheets

VALVE CONTROL SIGNAL
FREQUENCY 5HZ
DUTY CYCLE 70%
RESPONSE TIME 33MSEC.

INK PRESSURE ON
FORWARD UNCLOGGING
PROCESS RUN TIME
4 SEC.

INK PRESSURE OFF
REVERSE UNCLOGGING
PROCESS RUN TIME 4 SEC.

CROSS FLOW NOZZLE SYSTEM FOR AN INK JET PRINTER

BACKGROUND OF THE INVENTION

This invention relates to continuous jet, ink jet printers typically used for industrial purposes to mark products with bar codes, date codes and other important information. Continuous jet ink jet printers are well known in this art and will not be described in detail in this specification. For background, the reader is referred to Diebold et al. U.S. Pat. No. 4,121,222 hereby incorporated by reference. In brief, an ink jet printer of this type supplies ink to a nozzle which is typically stimulated by a piezoelectric device causing a stream of ink, emitted from an orifice formed in the nozzle to break-up into discrete droplets. At the point of break-up, a charge ring or similar device is provided to selectively charge drops which are desired to be deflected onto the substrate or product to be marked. Not all drops are so charged and the remaining drops pass to a gutter or recovery device which circulates the uncharged drops back to the ink supply system for reuse.

Clogging of continuous jet printers can be a problem, particularly when small orifices are utilized for high precision printing. In an effort to reduce clogs, nozzles are fabricated under clean room conditions in an attempt to ensure that particles and debris are not deposited in the nozzle or in the supply conduit which bring ink to the nozzle. In the ink supply system, filters are usually employed in an effort to catch impurities which may remain in the ink or which may form in the ink during operation of the system. Nevertheless, clogs do occur for various reasons. For example, the drop charging process can cause precipitation of ink dyes in the vicinity of the nozzle orifice. Over time, these deposits may clog the nozzle.

Efforts at unclogging nozzles are known in this art. In particular, nozzles having both an inlet and an outlet have been employed as disclosed, for example, in U.S. Pat. No. 4,771,297 to Lecheheb. In such device, ink is supplied to the nozzle through an inlet 4 while the outlet 5 is normally closed to form a disk-like reservoir of ink in conduits 10/11 facilitating transmission of stimulated energy thereto. In the event of a clog, printing is interrupted for purposes of unclogging the nozzle orifice 17. Orifice 17 is formed in a removable cap 3 which is secured to protrusion 20 by a bayonet mounting. Clogs are manually cleared by removing the cap and, if necessary, flushing ink using the outlet or bleed port 5. This is done by connecting the outlet of the dual-port nozzle to either vacuum or atmospheric pressure to alternately suck air in through the orifice or pass ink across the mouth of the orifice to remove any debris or clogging material. This operation in which printing must be interrupted for unclogging, is desirably accomplished within an optimally short period of time.

In a related art, namely ink jet array printing, as exemplified in U.S. Pat. No. 4,591,873 to McCann et al. it is also known to use two ports. The flow across the array is necessary to create and maintain an ink reservoir for the array. In addition, it is known to alternate the urging of ink in the orifices from one side to the other, i.e., from the ink cavity to the exterior and then back (See McCann, Col. 6, lines 13–34). However, there is no teaching of how to sense the unclogging other than to initiate printing operation. This has not been used in the single continuous jet art because of increase in the drool problem and the greater supply required.

It is accordingly an object of the present invention to provide a cross flow nozzle and an improved anti-clogging system for a continuous jet, ink jet printer. More specifically, it is desired to provide an anti-clogging system which both lessens the possibility of clogging of the orifice and, when clogging occurs, to detect and clear the clog and return the printer to normal operation within an optimal period of time.

It is another object of the invention to provide a system of the type described which is highly reliable and capable of extended periods of operation without significant clogging or downtime resulting therefrom.

Another object of the invention is to provide an anti-clogging system for an ink jet printer which is capable of detecting a blockage in an ink jet printhead orifice to initiate unclogging thereof and then detecting removal of the blockage.

A further object of the invention is to provide ink jet nozzles of a type which are suitable for use with the anti-clogging system of the present invention. These and other objects of the invention will be apparent from the remaining portion of this specification.

DETAILED DESCRIPTION

As indicated in the Background portion of this specification, it is known in the prior art to provide printheads with dual-ports for the purpose of unclogging of an orifice. In the prior art, however, the unclogging procedures were accomplished off-line after printer shut down. According to the present invention, a dual-port nozzle is employed in which ink is provided to the nozzle through a first port. A portion of the provided ink is forced through the nozzle orifice to form the jet stream for drop printing. The balance of the ink is used for "cross flow" purposes across the mouth of the orifice to keep the orifice purged of debris. This continuous flow of ink across the mouth of the orifice reduces the possibility of the orifice clogging during normal use of the printer.

Unlike the prior art, the present invention permits the detection of a clogged nozzle, unclogging thereof and return of the printer to normal operation within an optimal period of time. Normal operation resumes as soon as unclogging is detected. As a result, the manufacturing process for the invention is simplified and cost reduced because the use of clean room assembly techniques are less necessary.

The present invention permits particles which are blocking the orifice to be easily dislodged using a frequency modulated unclogging system. Furthermore, because of the cross flow of ink at the mouth of the orifice, there is less chance of a clog forming during regular printer operation. If blockage of the nozzle occurs, it can be detected and easily eliminated. No disassembly or servicing of the nozzle is required to unblock it nor is the printer returned to operation while still clogged and the ink in the system is not diluted by cleaning fluids, solvents or other foreign substances.

Figure 1A:
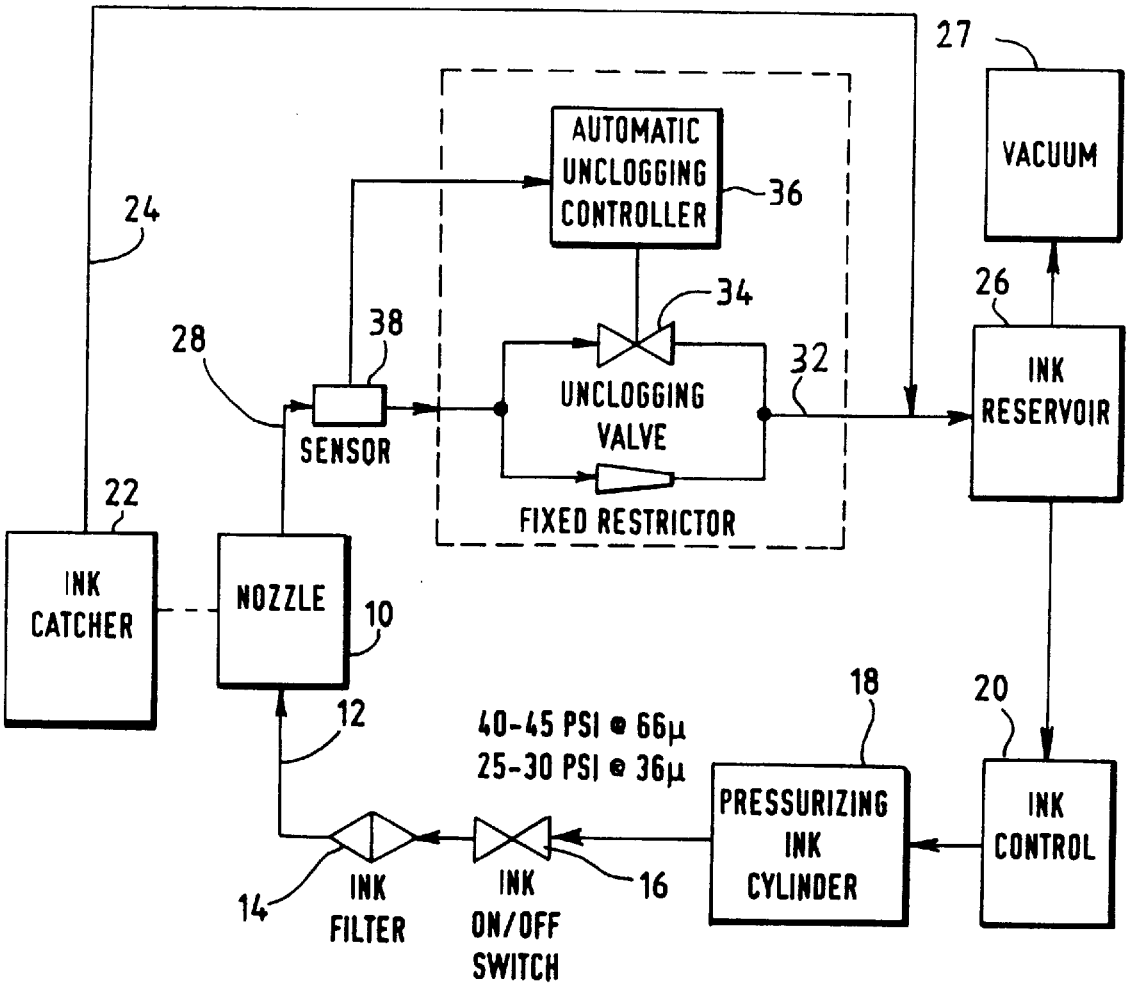
FIG. 1A illustrates the anti-clogging system of the present invention in block diagram form.

Referring to FIG. 1A, a block diagram of the invention is illustrated. A nozzle 10 receives a continuous supply of ink via supply line 12. Located in supply line 12 is an ink filter 14 and an ink on/off valve 16. The ink is provided to the supply line 12 from a pressurizing ink cylinder 18 under operation of an ink controller 20 of the type commonly used in this art. See, for example, U.S. Pat. No. 4,555,712, Arway et al. hereby incorporated by reference. A portion of the ink which reaches the nozzle 10 is emitted through a jewel orifice having an opening on the order of 25 to 80 microns. Some of the drops which are emitted are charged and deflected onto the product or substrate to be marked. Uncharged drops pass to an ink catcher 22 which returns the ink, via line 24, to an ink reservoir 26. The ink is returned by virtue of vacuum applied to the ink reservoir from vacuum source 27.

According to the present invention, the nozzle 10, is a dual-port nozzle so that a greater quantity of ink passes through the nozzle via line 12 than is emitted from the nozzle orifice. The balance of the ink is returned to the ink reservoir 26 via a second return line 28. Line 28 conveys the return ink via a fixed flow restrictor 30 and line 32 back to the reservoir 26. In parallel circuit with fixed flow restrictor 30, is a solenoid operated unclogging valve 34 which, when opened, also permits ink to flow from line 28 to line 32. Operation of the unclogging valve 34 is under control of an automatic unclogging controller 36. Controller 36 is a feedback type controller in which a comparison is made between a set point pressure and the pressure in line 28, as measured by a pressure sensor 38. When the pressure (absolute or differential pressure) detected by sensor 38 exceeds a threshold value, indicating that the nozzle orifice has, or is about to clog, the unclogging valve 34 is operated in a manner to be described, thereby to clear the clog. The printer is returned to operation after an unclogged status is sensed.

Figure 1B:
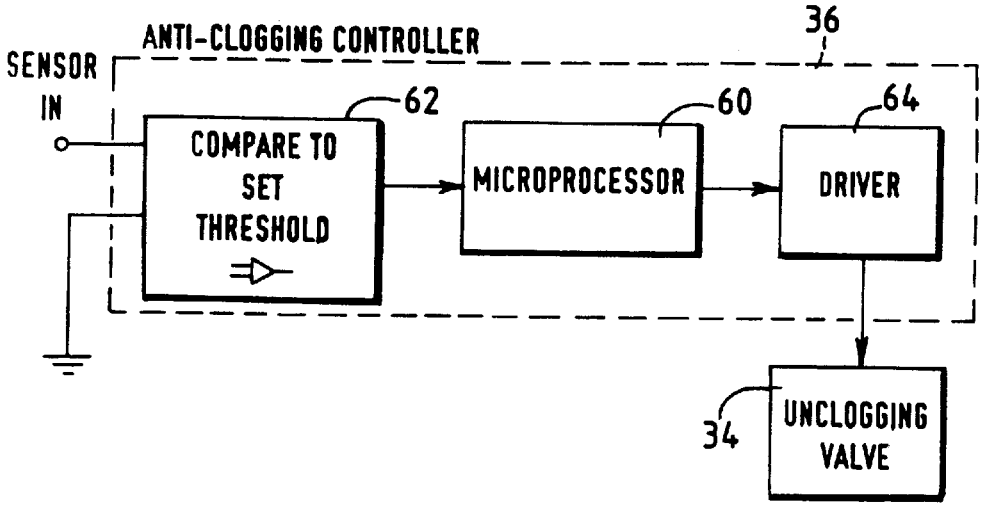
FIG. 1B illustrates the functional components of the unclogging controller.

Referring to FIG. 1B, a block diagram of the anti-clogging controller 36 is illustrated. Preferably the controller is a micro-processor based system including a micro-processor 60. One input to the processor is from a common type threshold circuit 62 which compares a threshold voltage with a voltage generated by the pressure sensor 38 as representative of the pressure in line 28. When the voltage from the sensor exceeds the threshold voltage, a signal is sent to the micro-processor indicating the presence of a clog in the orifice of the nozzle 10. This in turn causes the processor to actuate driver circuit 64 to operate the unclogging valve 34. As indicated previously, during normal printing, the nozzle outlet is restricted by the flow restrictor 30 to achieve proper ink pressure at the orifice to cause an ink stream to be ejected therefrom for printing purposes. When the unclogging process is activated, by operation of the unclogging valve 34, a significant pressure drop occurs in the nozzle because fluid will pass through both the unclogging valve 34 and the restrictor 30. As described hereafter, the controller 36 monitors the pressure level during the unclogging process. As soon as the pressure drops below the second threshold, the controller will terminate the unclogging process.

Figure 2A:
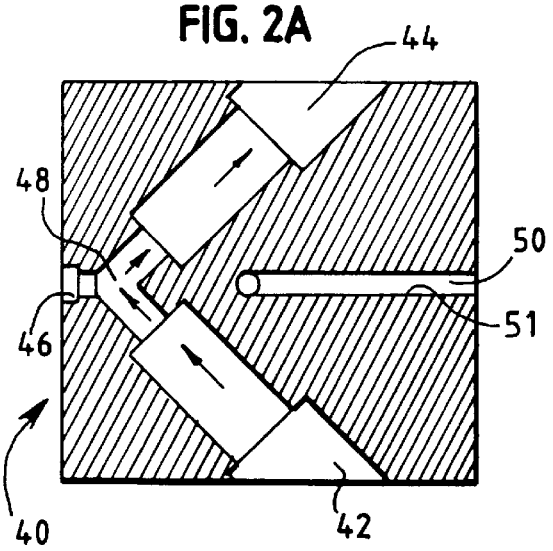
FIG. 2*a* illustrates a dual-port, cross-flow nozzle suitable for use in the present invention.

Referring to FIG. 2*a* a cross-sectional elevation of a nozzle suitable for use with the invention is illustrated. Nozzle 40 is formed from a block of suitable material such as Celcon. An ink inlet port 42 is provided, as is an ink outlet port 44. The inlet port communicates with the outlet port and the printing orifice 46 internally of the block at a point marked 48 in FIG. 2*a*. As illustrated by the relative size of the arrows at point 48, a significant quantity of ink flows in through port 42. A portion of the ink is ejected through the orifice 46 to form an ink stream for printing purposes, with the balance flowing through the outlet 44 back to the ink reservoir 26 of FIG. 1 via line 28. The stream of ink emitted from the orifice breaks into drops due to the stimulation energy from a piezoelectric device 50 which is secured to the block in the opening 51 and operated in a manner well known in this art. The size of the orifice 46 is controlled by the opening diameter of the jewel which is positioned therein. Typically these jewels can have an aperture in the range of 25 to 80 microns with 36 microns and 66 microns being common sizes.

Figure 2B:
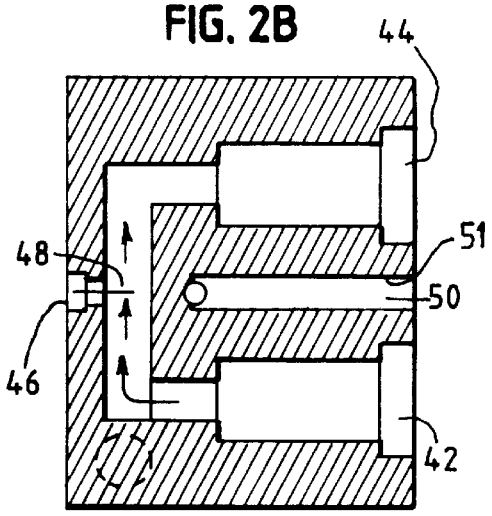
FIG. 2*b* illustrates a second embodiment of a dual-port, cross-flow nozzle.

FIG. 2*b* illustrates a second version of a nozzle suitable for use with the present invention. The benefit of the FIG. 2*b* embodiment is the reduction in overall nozzle size which is possible due the rectangular arrangement of the inlet and outlet ports, making it more suitable for retrofitting for use with existing printer systems.

Figure 2C:
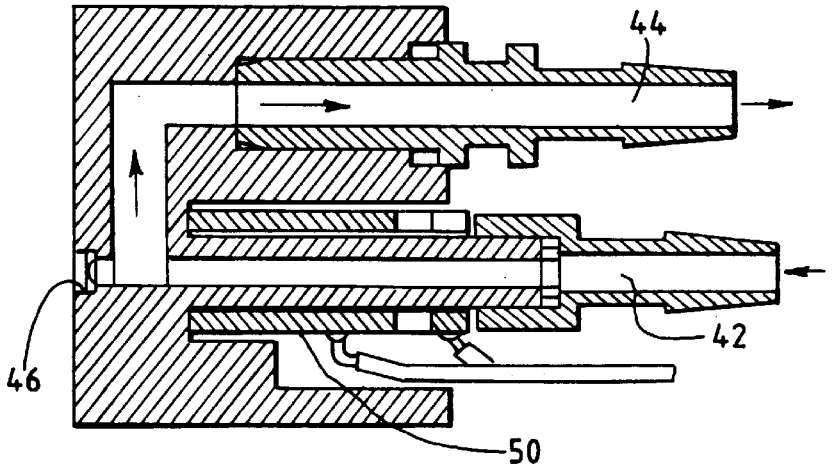
FIG. 2*c* illustrates a third, preferred embodiment of a cross-flow nozzle.

The dual-ported nozzle of the invention allows constant ink flow across the mouth of the orifice (point 48 in FIGS. 2*a* and 2*b*) during printing. This cross-flow largely prevents particles from depositing in that area which could cause a clog. The nozzle can be made very compact if desired. This is facilitated by using a slab type piezoelectric crystal 50 for excitation purposes. The crystal is positioned in the slot 51 formed at the back of the nozzle permitting ease of assembly. FIG. 2*c* illustrates a third, presently preferred nozzle. The PZT crystal 50 is located close to the orifice and disposed along the inlet path 42. This more effectively couple s the drop forming energy to the ink stream resulting in better printing capability.

The outlet of the nozzle 10 is connected to line 28 which leads to parallel combination of fixed flow restrictor 30 and unclogging valve 34. The purpose of the fixed restrictor 30 is to achieve proper ink pressure at the orifice while printing. During normal printing, no ink passes through the unclogging valve 34. When the unclogging process is active, however, ink does pass through unclogging valve 34, as well as fixed resistor 30. To exemplify the operation of the system as thus far described, two examples will be given.

EXAMPLE 1

Orifice size: 66 microns.

Inlet port flow rate: 10 ml/min.

Orifice flow rate: 5 ml/min.

Outlet flow rate: 5 ml/min.

EXAMPLE 2

Orifice size: 36 microns.

Inlet port flow rate: 4 ml/min

Orifice: 1 ml/min.

Outlet: 3 ml/min.

In both of the examples it can be seen that a significant portion (at least half) of the ink which flows into the nozzle is used for continuous cross-flushing purposes to reduce the possibility of clogging, thereby greatly extending the mean time between clogs.

Figure 3A:
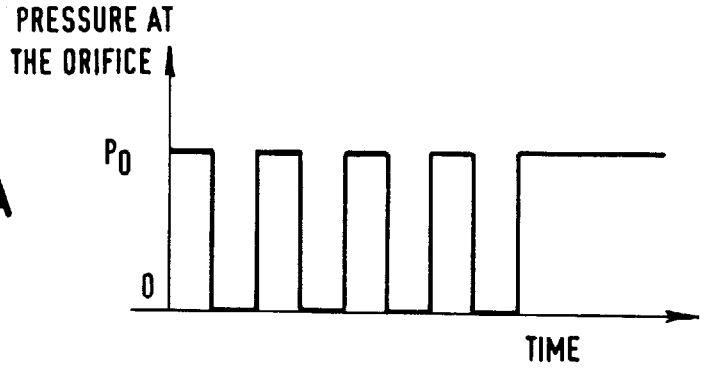
FIGS. 3*a* and 3*b* contain wave forms useful in explaining operation of the anti-clogging system according to a first mode of operation.
Figure 3B:
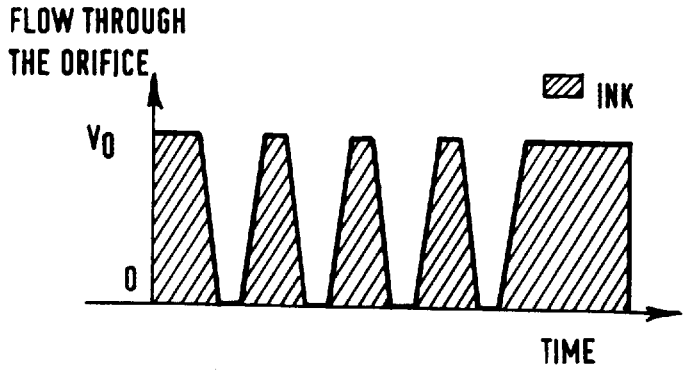
Figure 4A:
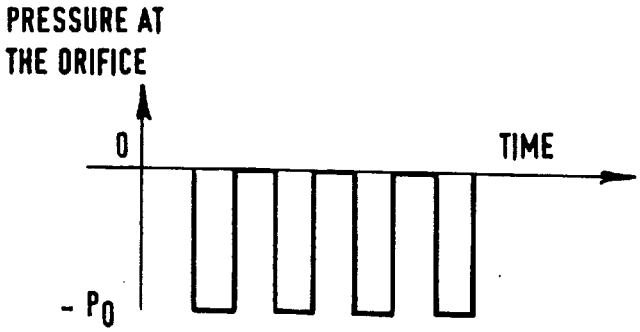
FIGS. 4*a* and 4*b* contain wave forms useful in understanding operation of a second, preferred mode of the invention.
Figure 4B:
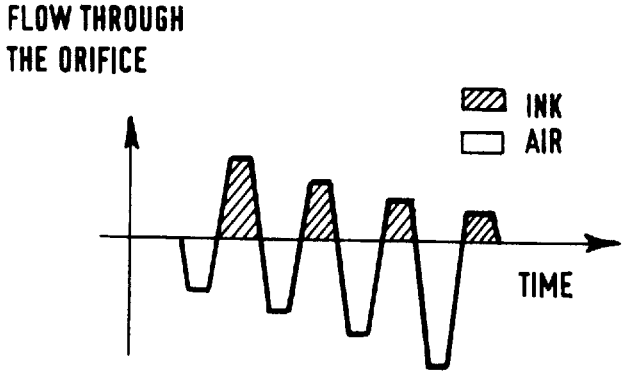

Referring to FIGS. 3*a* and 3*b*, there is illustrated a first unclogging mode of operation according to the present invention. The mode illustrated in FIGS. 3*a* and 3*b* is referred to herein as "forward" unclogging. The second mode, illustrated in FIGS. 4*a* and 4*b* is referred to as "reverse" unclogging. During normal printer operation, the ink pressure in the supply conduit 12 is typically in the range of 40 to 45 psi for a 66 micron orifice. For a 36 micron orifice, a typical pressure is in the range of 25 to 30 psi. During the forward unclogging process, the ink switch 16 (FIG. 1) remains on so that ink is flowing through the nozzle. When a clog is detected by sensor 38, unclogging valve 34 is operated, significantly dropping the pressure and increasing the ink flow past the mouth of the orifice. That is, the flow rate past the orifice mouth is significantly greater than during normal printing operation. Simultaneously with the increase in flow rate, there is a marked drop in flow through the orifice. This creates a partial suction at the orifice which may draw air therein tending to dislodge any particles responsible for a clog. These particles are swept away by the ink flow past the orifice and are returned to the ink reservoir where they are eventually caught by the filter 14.

Referring specifically to FIGS. 3*a* and 3*b*, it will be seen that the micro-processor 60 preferably operates the unclogging valve 34 in a pulsed mode in which it is switched on and then off. In FIG. 3*a*, the nominal operating pressure of the system ($P_g$) is shown varying over time as the unclogging valve is turned on and then off. Each time it is turned on, the orifice pressure rapidly drops, almost to zero, as measured at the orifice of the nozzle 10. Thus, there is insufficient pressure to force ink through the orifice and, in fact, there may be a slight back pressure. As shown in FIG. 3*b*, the flow of ink through the orifice closely matches the pressure drop, reaching zero and then climbing back up when the unclogging valve is closed. The oscillating action is important as it virtually guarantees that the clog will be dislodged. In order to maximize the unblocking action, the frequency of the switching operation of the valve should be selected to maximize the amplitude of the fluid oscillation in the region of the block. The preferred frequency will vary depending upon the type of nozzle used, type of ink and conduit and the diameter of the orifice. Fortunately, the preferred frequency may be easily determined, without undue experimentation, by empirical means. Typically the frequency will be in the range of about one to ten hertz. Alternatively, it is possible to use a variable frequency to "sweep" the preferred range thereby ensuring that at least some portion of the unclogging cycle will be particularly effective. This sweeping is preferred because it compensates for deficiencies in ink, manufacturing variance and different particle sizes and shapes insuring a quick unclog.

Referring to FIGS. 4*a* and 4*b*, a second and preferred unclogging mode is illustrated. This mode, referred to as the reverse unclogging mode, differs in that when initiated the ink switch 16 is shut-off. Thus, only the small amount of ink trapped in line 12 between the switch 16 and the nozzle 10 can be drawn through the nozzle back to the reservoir 26. In this reverse mode, a pulsed, negative pressure is applied to the orifice of the nozzle 10 to draw out any particles stuck in the orifice. As shown in FIG. 1, the negative pressure is created as a result of the vacuum from vacuum source 27.

It has been determined that the reverse mode is more effective at unclogging a nozzle than the forward mode, although both satisfactorily accomplish the objectives of the invention. In operation, the reverse unclogging mode is initiated when the sensor 38 detects a clog. Ink switch 16 is shut-off to stop the flow of ink from cylinder 18. The controller 36 then opens the unclogging valve 34 connecting the return path 28 to the vacuum source 27, via the ink reservoir 26. This quickly sucks the limited supply of ink still in the lines 12, 28, 32 and in nozzle 10 back to the reservoir. Thereafter, the vacuum begins to draw air through the orifice 46. When the controller closes the unclogging valve, after a short period of operation, residual pressure pushes ink back through the orifice. As with the forward embodiment, the cycle is repeated either at a fixed frequency (such as five hertz) or at a variable frequency sweeping the preferred range until the pressure sensor 38 detects that the orifice is clear.

Referring to FIGS. 4*a* and 4*b*, with the ink switch 16 closed, the pressure at the orifice quickly goes to a negative value and initiates the flow of air into the orifice. When the unclogging valve is closed, ink again begins to flow through the nozzle, although with each repetition of the cycle less and less ink flows. This phenomenon can be understood by recognition of the fact that the ink supply conduit 12 is a flexible line which expands slightly over its length when pressurized to the 25 to 45 psi at which the printer normally operates. Thus, even after the switch 16 is closed, there is residual ink pressure in the line 12 which is available to push ink through the orifice during the portion of the cycle when the unclogging valve is closed. FIG. 4*b* shows the back and forth movement of air and ink through the orifice, as a result of cyclical operation of the unclogging valve. The result is sufficient force to ensure that the clog is cleared.

Referring to FIGS. 5 (A–D) the effect of the reverse mode unclogging operation is graphically illustrated. FIG. 5 is a plot made for a thirty-six micron clogged nozzle. The top wave form 100 shown in FIG. 5A is the valve control signal supplied by the micro-processor to the driver 64 of FIG. 1A to operate the unclogging valve 34. The wave form has a frequency of five hertz with a duty cycle of seventy percent. The second wave form 102 shown in FIG. 5B illustrates the response measured by the pressure sensor 38 in a reverse unclogging operating mode. As can be seen, each time that the valve is switched on negative pressure builds up at the sensor. In wave form 104 shown in FIG. 5C, the process continues with the controller monitoring the pressure amplitude to see when the pressure drops below a threshold indicating successful unclogging. Finally, at wave form 106 shown in FIG. 5D, a virtually flat curve is obtained indicating that the nozzle has been unclogged. The unclog threshold is indicated at 107. Upon receiving a signal from the sensor 38 that the pressure is less than an unclog threshold, the micro-processor 60 terminates the unclog mode of operation, permitting immediate resumption of printing.

Figure 5A:
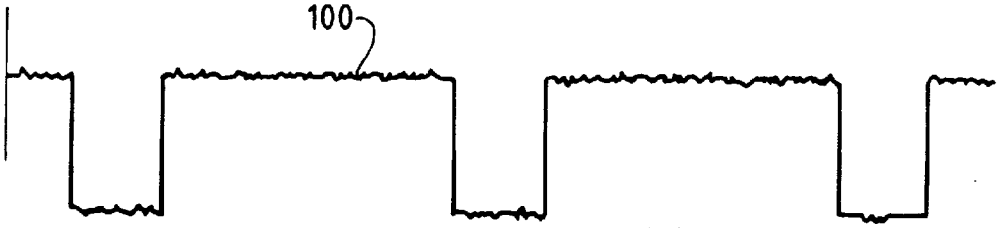
FIGS. 5A–5D illustrates voltage versus time wave forms illustrating the operation of the system and the change therein when a nozzle is unclogged.
Figure 5B:
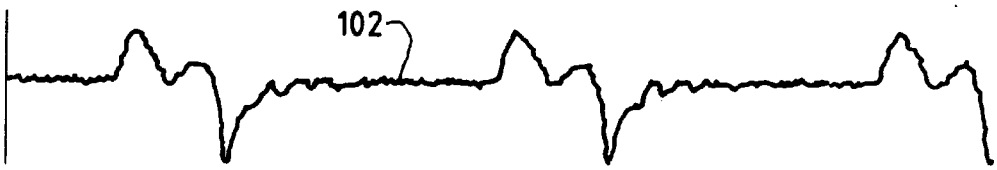
Figure 5C:
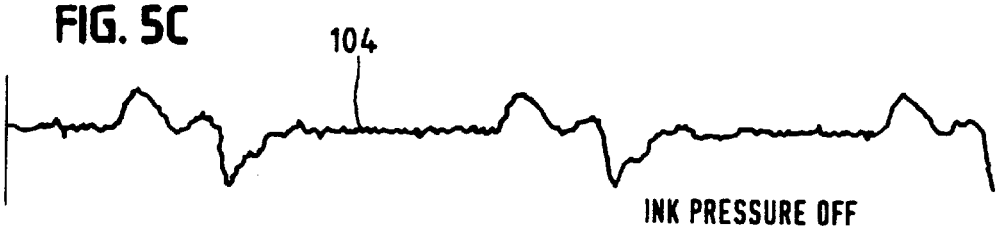
Figure 5D:
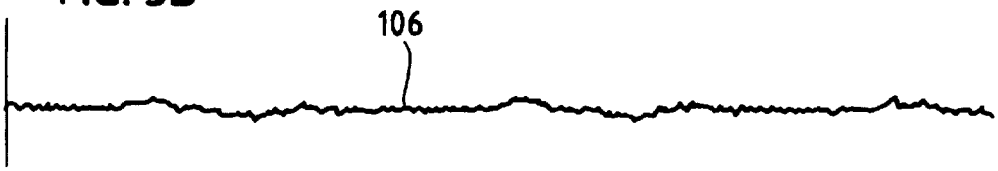

As indicated in connection with FIG. 5D, both clogging and unclogging are preferably detected by the pressure transducer. In this case, the pressure sensor is located on the outside of the flexible tubing used to convey ink from the cross flow nozzle back to the reservoir. Thus, an unclogging cycle is initiated when an increase in pressure in the ink return line is detected sufficient to indicate a clogged condition. As the unclogging cycle proceeds, the controller monitors the pressure signal until the absolute value falls below a second threshold. When the pressure falls below this threshold, it is an indication that the clog has been cleared and that the unclogging cycle may terminate. Thereafter, the printer is promptly returned to service.

Figure 6:
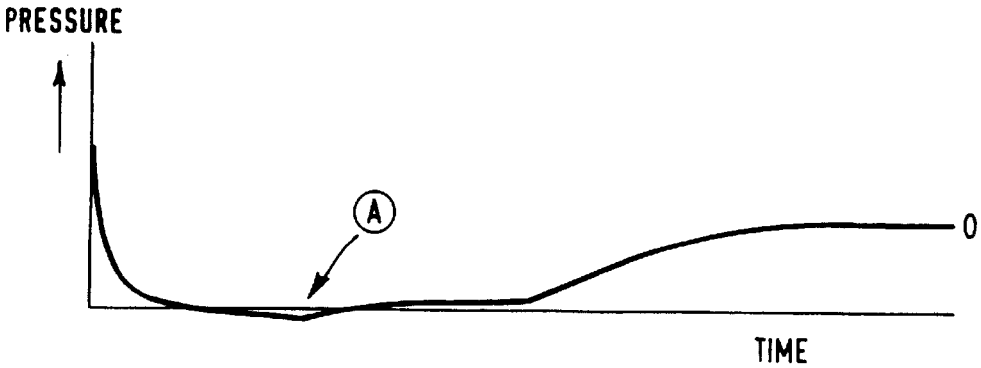
FIG. 6 illustrates a wave form generated by a pressure transducer placed in direct contact with the ink.

Referring to FIG. 6, there is illustrated a wave form representing the output of a different type of pressure transducer. This transducer is placed in direct contact with the ink. The illustrated wave form shows that as the unclogging operation proceeds, there is a significant pressure drop until at point A, a small inflection appears. The inflection at point A represents unclogging of the nozzle and may be detected and used as a signal to terminate the unclogging operation and to return the printer to normal operation. In the graph illustrated in FIG. 6, the anticlogging system is operating at a fixed frequency, although a variable frequency may also be used.

To summarize, depending upon the type of pressure transducer employed, a threshold level, such as level 107 in FIG. 5D may be used to detect the unclogged condition or, where a pressure transducer is employed in direct contact with ink, the inflection point A of FIG. 6 can be used to signal the unclogged condition. Regardless of which type of transducer and method is employed, when unclogging is detected, the unclogging procedure is terminated and the printer is promptly returned to normal service.

Although it is preferred to detect a clog condition by means of a pressure sensor, such as sensor 38 in FIG. 1, there are circumstances when it may be desirable to do otherwise. For example, in some existing jet printing equipment, for which the present invention may be adapted for use, it is difficult to sense a clog by pressure alone due to the small magnitude of the pressure increase. In such circumstances, it is possible to detect a nozzle clog by other means, such as determining that a phasing fault, high voltage fault or "no signal" fault has occurred. This may include opto-sensing of the ink stream from the nozzle. In addition, flow time measurements can be used as an indicator of a nozzle clog. As is known in this art, the flow time of the ink from the ink reservoir 26 to the nozzle 10 can be measured, for example, as disclosed in the aforementioned Arway U.S. Pat. No. 4,555,712.

For the system illustrated in FIG. 1, the following table provides flow time information which can be used by the system controller to detect a nozzle clog. As shown in the table, during normal printing operations, the flow time is on the order of 33 seconds for a flow rate of 4.5 ml/min at the orifice. In the event of a clog, the flow time will change dramatically (almost doubling) to approximately 61 seconds while the flow rate at the orifice will have dropped to zero, or nearly so. In the event that the system employs flow time measurement, the pressure sensor 38 may be omitted with and the nozzle unclogging valve 34 operated by controller 36 as a function of flow time or one of the other aforementioned indications.

FLOW RATE MEASUREMENT

| Nozzle (microm | Ink Pressure (psi) | Flow Time (seconds) | Status | Flow Rate at Orifice(ml/min) |
|---|---|---|---|---|
| 66 | 40 | 33.41 | Printing | 4.5 |
| | | 61.40 | Clog | 0 |

From the foregoing, it will be understood that the present invention relates to a continuous jet ink jet printer used for marking objects on a substrate. The unclogging system of the invention, permits substantially continuous operation of the printer by clearing clogs whenever detected. There is no need to take the printer off-line and disassemble the nozzle. Instead, when a clog is detected, an unclogging cycle is initiated automatically, the clog is precisely cleared, and the system returned to printing mode usually in less than ten seconds.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed:

1. An anti-clogging nozzle system for a continuous ink jet printer for projecting ink as a uniform and regularly spaced stream of ink droplets, comprising:

a) an ink supply (26);

b) a nozzle body (10) including i) an orifice (46) arranged to allow passage of ink;

ii) an inlet passageway (42) linked to said ink supply and said orifice for supplying ink to said orifice;

iii) an outlet passageway (44) in said body connected to said inlet passageway for conveying from said body, ink not passing through said orifice;

c) pressurizing means (16, 18, 20) for providing sufficient pressure to cause:

i) a continuous flow of ink through said inlet passageway and said outlet passageway past said orifice, during printing, to minimize clogging; and ii) a continuous flow of ink through said orifice;

d) a piezoelectric transducer (50) supported by said body for introducing perturbations into the ink stream emanating from said orifice to form said stream of uniformly sized ink droplets.

2. An anti-clogging nozzle system for a continuous ink jet printer comprising:

a) an ink supply (26);

b) a nozzle body (10) including an orifice arranged to allow passage of ink;

i) an inlet passageway (42) in said body linked to said ink supply and said orifice for conveying ink to said orifice from said ink supply;

ii) an outlet passageway (44) in said body connected to said inlet passageway and linked to said ink supply for conveying back to said ink supply, ink not passing through said orifice, c) pressurizing means (16,18,20) for providing a continuous cross-flow of ink through said inlet passageway and said outlet passageway, past said orifice during printing, thereby to minimize clogging;

d) a transducer (50) supported by said body for introducing perturbations into the ink passing through said orifice to form droplets;

e) a flow restrictor (30) located between said outlet passageway and said ink supply to maintain a desired ink pressure at said orifice during printing;

f) means (34) for cyclically varying the ink pressure at said orifice; and g) means (36) for controlling operation of said means (34) for cyclically varying, wherein said means for controlling initiates operation of said means for cyclically varying.

3. The nozzle system according to claim 2 wherein said means for controlling (36) is responsive to means for measuring a flow rate of ink to said nozzle (10) to detect a decrease therein and to initiate operation of said means for cyclically varying (34) until said orifice is unclogged.

4. The nozzle system according to claim 2 wherein said means for controlling (36) is responsive to means for measuring a flow rate of ink to said nozzle (10) to detect a decrease therein associated with said orifice being clogged and to initiate operation of said means for cyclically varying (34) until said orifice is unclogged.

5. The nozzle system according to claim 4 wherein said means for controlling (36) compares the output value of said pressure sensor (38) with a predetermined threshold value and initiates said means for cyclically varying (34) when the output value exceeds the threshold value.

6. The nozzle system of claim 4 wherein said means for controlling (36) terminates operation of said means for cyclically varying the ink pressure (34) when said pressure sensor (38) detects a pressure decrease indicating that the nozzle (10) has been unclogged.

7. The nozzle system according to claim 2 wherein said means for cyclically varying comprises an unclogging valve (34) and wherein said means for controlling (36) includes means for cyclically operating said unclogging valve.

8. The nozzle system according to claim 7 further including a vacuum source (27) on the downstream side of said unclogging valve (34) to reduce the ink pressure at said orifice (46) when said unclogging valve is operated.

9. The nozzle system according to claim 7 wherein said unclogging valve is in parallel circuit with said flow restrictor between said outlet passageway and said ink supply, operation of said valve reducing ink pressure at said orifice.

10. A system for reducing clogging and for unclogging an orifice of a nozzle used for continuous ink jet printing comprising:

a) a nozzle (10) having
   i) an orifice (46) arranged to allow passage of ink;
   ii) an inlet passageway (42) linked to said orifice;
   iii) an outlet passageway (44) linked to said inlet passageway;

b) an ink supply (26), linked to said inlet passageway (42), for supplying ink through said inlet passageway to said nozzle orifice (46), ink not passing through said orifice being returned to said ink supply through said outlet passageway to create a continuous cross flow of ink past said nozzle orifice during printing to minimize clogging; said ink supply further comprising means (16, 18, 20, 30) for maintaining sufficient ink pressure at the orifice to cause a portion of the ink to flow through the orifice for printing purposes;

c) means (38) for detecting a nozzle clog; and d) means (34) for cyclically varying the ink pressure at said orifice; and e) means (36) for controlling said means for cyclically varying in response to said detection of a nozzle clog.

11. The system according to claim 10 wherein said means for maintaining sufficient ink pressure includes a flow restrictor (30) located downstream of said orifice (46) to increase ink pressure at said orifice during printing.

12. The system according to claim 11 wherein said means (36) for controlling activates said means (34) for cyclically varying the ink pressure in the event of a clog until said orifice (46) is unclogged.

13. The system according to claim 12 wherein said means for detecting a nozzle clog (38) comprises flow rate measuring means for measuring a flow rate of ink to said nozzle (10), and wherein said means for controlling (36) initiates operation of said means for cyclically varying in response to a flow rate decrease detected by said flow rate measuring means due to a clog, and maintains operation of said means for cyclically varying (34) until said orifice (46) is unclogged.

14. The system according to claim 12 wherein said means for detecting a nozzle clog comprises a pressure sensor (38) located downstream of said orifice (46), wherein said means for controlling (36) is responsive to said pressure sensor, and wherein said means for controlling initiates operation of said means for cyclically varying in response to a pressure increase detected by said pressure sensor due to a clog, and maintains operation of said means for cyclically varying (34) until said orifice is unclogged.

15. The system according to claim 14 wherein said means for controlling (36) compares the output value of said pressure sensor (38) with a predetermined threshold value and initiates said means for cyclically varying (34) when the output value exceeds the threshold value.

16. The system of claim 14 wherein said means for controlling (36) terminates operation of said means for cyclically varying the ink pressure (34) when said pressure sensor (38) detects a pressure decrease consistent with the nozzle (46) having been unclogged.

17. The nozzle system according to claim 12 wherein said means for cyclically varying (34) comprises an unclogging valve, and wherein said means for controlling (36) includes means for cyclically operating said unclogging valve.

18. The system according to claim 17 wherein said unclogging valve (34) is in parallel circuit with said flow restrictor (30) between said outlet passageway (44) and said ink supply (26), operation of said unclogging valve reducing ink pressure at said orifice (46).

19. The system according to claim 17 further including a vacuum source (27) on the downstream side of said unclogging valve (34) to reduce the ink pressure at said orifice (46) when said unclogging valve is operated.

20. A method for reducing the occurrence of clogging and for unclogging an orifice (46) of a nozzle (10) used for continuous ink jet printing comprising the steps of:

a) supplying ink to said nozzle orifice through an inlet passageway (42), directing ink not passing through said orifice through an outlet passageway (44) from said orifice to create a continuous cross flow of ink past said orifice during printing;

b) maintaining sufficient ink pressure in a first mode of operation at the orifice to cause a desired portion of the ink to flow through the orifice for printing purposes;

c) cyclically varying the ink pressure at said orifice in a second mode of operation whereby to unclog the orifice.

* * * * *